US005347351A

United States Patent [19]

Morita et al.

[11] Patent Number: 5,347,351

[45] Date of Patent: Sep. 13, 1994

[54] IMAGE FORMING APPARATUS FOR COPYING ONE AND TWO-SIDED DOCUMENTS

[75] Inventors: Shizuo Morita; Masakazu Fukuchi; Satoshi Haneda, all of Hachioji, Japan

[73] Assignee: Konica Corporation, Tokyo, Japan

[21] Appl. No.: 64,408

[22] Filed: May 19, 1993

[30] Foreign Application Priority Data

Jun. 2, 1992 [JP] Japan ..... 4-141644
Sep. 24, 1992 [JP] Japan ..... 4-254942

[51] Int. Cl.[5] ..... G03G 21/00
[52] U.S. Cl. ..... 355/313; 355/326
[58] Field of Search ..... 355/313, 319, 320, 326, 355/327; 346/157

[56] References Cited

U.S. PATENT DOCUMENTS 5,005,049 4/1991 Matsushita ..... 355/208
5,038,182 8/1991 Tanimoto ..... 355/320

*Primary Examiner*—R. L. Moses
*Attorney, Agent, or Firm*—Frishauf, Holtz, Goodman & Woodward

[57] ABSTRACT

An image forming apparatus has a plurality of mixed input thereto including one-sided and two-sided documents, and then copied on sheets which are successively outputted in accordance with the supplied documents. The apparatus has a feeder to feed the documents to a reading station, and a discriminator to discriminate whether each of the documents is a one-sided or a two-sided document. Then the apparatus selectively outputs copied sheets in either a one-sided copy mode, a two-sided copy mode or a mixed copy mode in which one-sided and two-sided copy sheets are outputted in accordance with the mixed one-sided and two-sided documents.

7 Claims, 14 Drawing Sheets

IMAGE FORMING APPARATUS FOR COPYING ONE AND TWO-SIDED DOCUMENTS

BACKGROUND OF THE INVENTION

The present invention relates to a two-side image forming apparatus capable of automatically copying mixed documents including one-sided and two-sided documents onto the front and rear sides of transfer sheets.

In the case of a conventional two-sided image forming apparatus having an automatic document feeder, copying operations are carried out in the following manner: When a large number of documents are to be continuously copied, an operator checks whether they are one-sided or two-sided documents. Then, the operator selects either a one-sided or a two-sided mode. After that, a copy start command is given to the apparatus.

Accordingly, in the case where mixed documents including one-sided and two-sided documents are continuously copied with the image forming apparatus, it is necessary for the operator to previously sort the documents into one-sided and two-sided ones, and then the operator designates the copy mode for each of the one-sided and two-sided documents so as to carry out a copying operation. Therefore, the copying operation is very inefficient.

SUMMARY OF THE INVENTION

It is an object of the present invention to provide an image forming apparatus capable of automatically conducting a copying operation in accordance with mixed documents including one-sided and two-sided documents and also capable of conducting the copying operation with a designated arbitrary copy mode.

The first embodiment of the present invention to accomplish the above object is described as follows: The image forming apparatus of the first embodiment is continuously inputted with a plurality of mixed documents including one-sided and two-sided documents, and then copied sheets are successively outputted in accordance with the supplied documents. The two-sided image forming apparatus of the first embodiment comprises a supply means to supply the documents, and a discrimination means to discriminate whether the documents are one-sided or two-sided documents. Then the image forming apparatus of the first embodiment selectively outputs copied sheets in either a one-sided copy mode, two-sided copy mode or mixed copy mode by which one-sided and two-sided copy sheets are outputted in accordance with mixed one-sided and two-sided documents.

The second embodiment of the present invention is described as follows:

The image forming apparatus of the first embodiment is continuously inputted with a plurality of mixed documents including one-sided and two-sided documents, and then copied sheets are successively outputted in accordance with the supplied documents. The image forming apparatus of the second embodiment comprises a supply means to supply the documents, and a discrimination means to discriminate whether the documents are one-sided or two-sided documents, and also to discriminate whether the documents are monochrome or color. Then the image forming apparatus of the first embodiment selectively outputs copied sheets in either a one-sided copy mode, two-sided copy mode or mixed copy mode by which one-sided and two-sided copy sheets are outputted in accordance with mixed one-sided and two-sided documents.

BRIEF DESCRIPTION OF THE DRAWINGS

FIG. 3(*b*) is its control circuit diagram;

FIG. 10(*b*) is its control circuit diagram;

DETAILED DESCRIPTION OF THE PREFERRED EMBODIMENTS

Figure 1:
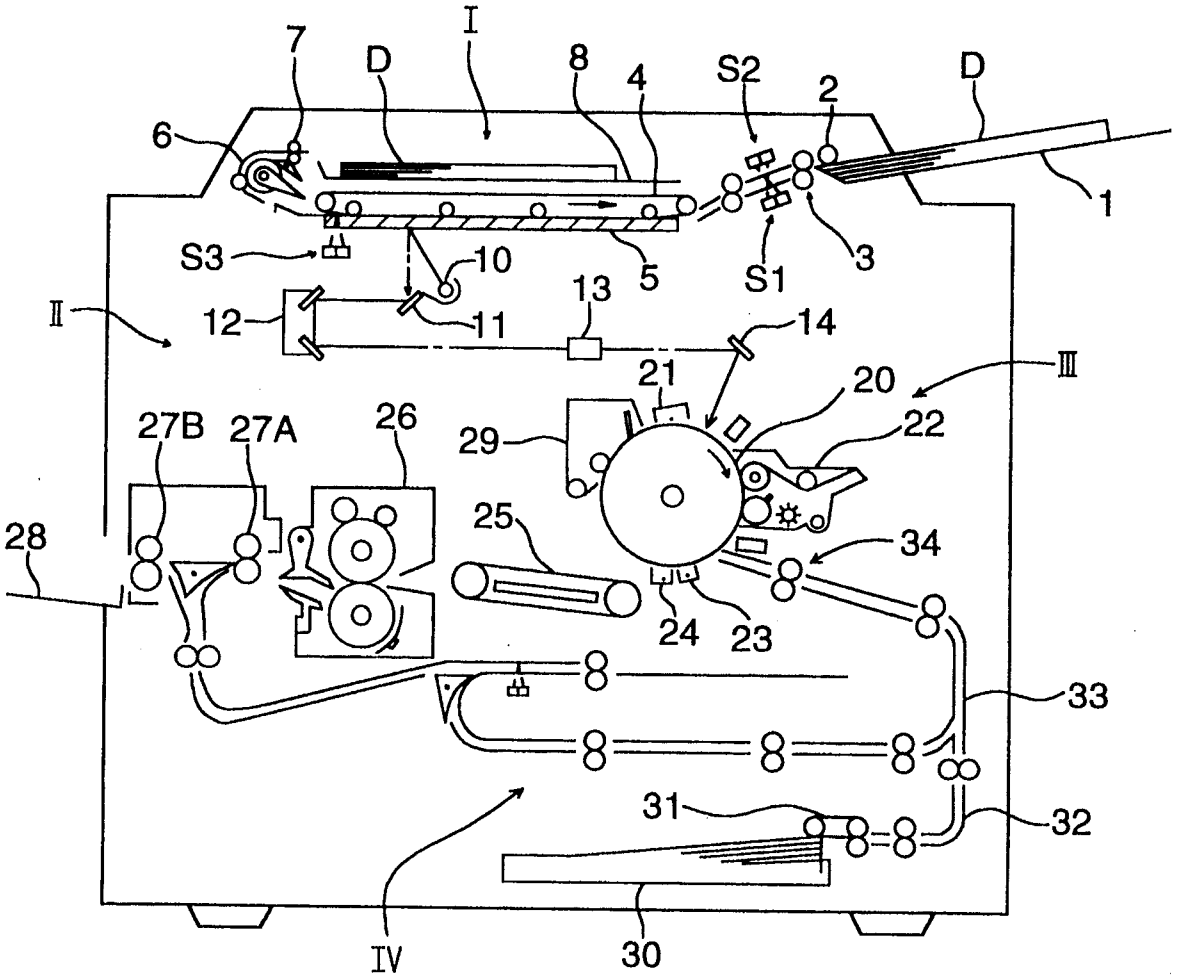
FIG. 1 is a schematic view showing the structure of the image forming apparatus of the present invention (part 1)
Figure 2:
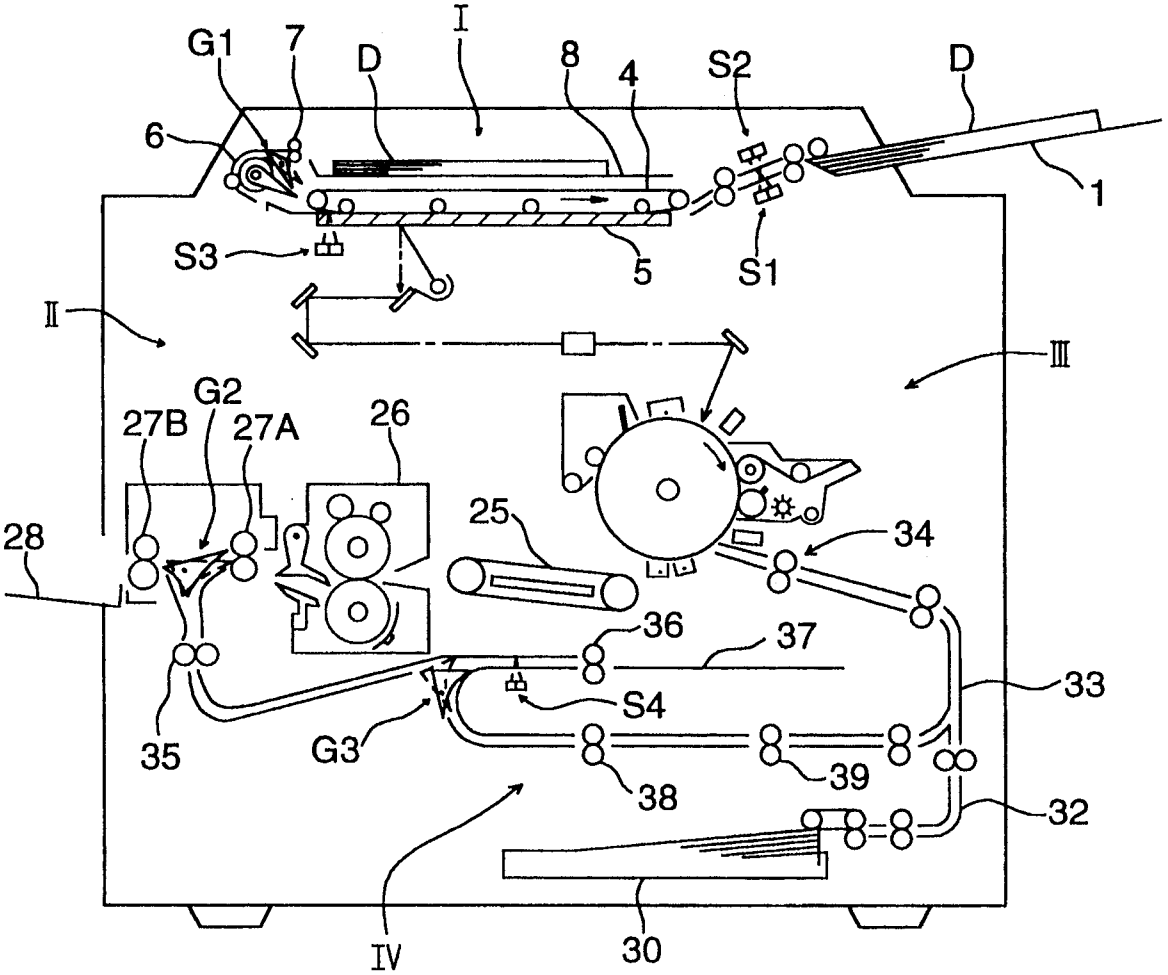
FIG. 2 is also a schematic view showing the structure of the image forming apparatus of the present invention (part 2)

FIGS. 1 and 2 are schematic views showing the structure of an example of the image forming apparatus of the present invention. This apparatus is composed of an automatic document feeder having reversal function (ADF) I, image exposure section II, image forming section III, and automatic duplex copying unit (ADU) IV.

First, referring to FIG. 1, a copying process for one-sided documents carried out by the apparatus will be explained as follows.

Documents D are stacked on a document tray 1 of ADF I under the condition that the image surfaces of documents D are set downward. When a copy button is pressed, a conveyance roller 2 is rotated, so that the uppermost document of the stack and others are successively conveyed.

Only the uppermost document D is conveyed by the action of a double feed prevention roller 3. Existence of an image on the document surface is checked by photosensor S1. After that, the document D is fed onto a platen glass 5 by a conveyance belt 4.

When document D has been fed onto the platen glass 5, the leading edge of document D is detected by photosensor S3. Then, the rotation (clockwise) of the conveyance belt 4 is stopped, so that document D is stopped at a predetermined exposure position. Next, image exposure section II is operated, and exposure scanning is conducted by a first mirror 11 incorporating an exposure lamp 10, and a second mirror unit 12 that follows the first mirror 11 at a half speed of the first mirror 11. As a result of the foregoing exposure operation, the document image is projected through an image formation lens 13 and a third mirror 14 on a circumferential surface of a photoreceptor drum 20 of image forming section III that has been previously given an electrical potential by a charger 21, so that an electrostatic latent image is formed on the photoreceptor drum 20.

This electrostatic latent image is developed with a developing unit 22 so that the image can be visualized. In this manner, a toner image of the document image is formed on the circumferential surface of the photoreceptor drum 20.

Simultaneously with completion of the exposure operation, the conveyance belt 4 is rotated again, so that document D is discharged onto a document tray 8 by a discharge roller 7 through a reversal guide section 6. In the case where the existence of an image has not been detected by photosensor S1, document D is not stopped on the platen glass 5 and conveyed onto the document tray 8. In this case, the exposure operation is not carried out by image exposure section II.

In parallel with the operations conducted in image exposure section II and image forming section III, recording papers are conveyed out from a paper feeding cassette in the ADU IV. By the action of a double feed prevention roller 31, one sheet of recording paper is conveyed to a timing roller 34 through paper feed guides 32 and 33. Then, the recording paper is conveyed to an image transfer region by the rotation of a timing roller 34 rotated synchronously with a toner image formed on the photoreceptor drum 20.

The toner image on the photoreceptor drum 20 is transferred by a transfer unit 23 onto the recording paper fed in an image transfer region. Then, the recording paper is separated from the surface of the drum by the action of a discharger 24, and conveyed to a fixing unit 26 through a conveyance belt 25 so that the toner is fused and fixed. After that, the recording paper is discharged onto a recording paper tray 28 through paper discharging rollers 27A and 27B. On the other hand, residual toner is removed from the surface of the photoreceptor drum from which the recording paper has been separated, and then the apparatus enters the next document image forming process.

Next, with reference to FIG. 2, a copying process of two-sided documents will be explained as follows.

A document D is conveyed out from the document tray 1. Then, an image on the front side and that on the rear side are respectively detected by photosensors S1 and S2. After that, in the same manner as the copying operation of one-sided documents, the image on the front side is exposed and formed on a photoreceptor drum, and transferred and fixed onto a recording sheet.

The recording paper, onto which the image has been fixed, is discharged onto an intermediate tray 37 being guided by guide members G2 and G3 that have previously been rotated to a position illustrated by a solid line in accordance with the image detection signal sent from photosensor S2, the recording paper also being conveyed by conveyance rollers 35 and 36 driven in accordance with the image detection signal. Then, the recording paper is stopped under the condition that it is held by a conveyance roller 36 that has been stopped in accordance with a trailing end detection signal sent from photosensor S4.

On the other hand, document D that has already been exposed and conveyed to a reversal guide section 6 is reversed and conveyed again onto the platen glass 5 by the action of guide member G1 rotated to a position shown by a solid line in accordance with an image detection signal of photosensor S2 and also by the action of the conveyance belt 4 reversely rotated (that is, the conveyance belt is rotated counterclockwise). In this way, the recording paper is conveyed onto the platen glass 5 under the reversed condition. In this case, the recording paper is stopped in a predetermined position in accordance with a trailing end detection signal of photosensor S3, the detection mode of which has already been changed over.

Then, the conveyance roller 36 is reversed synchronously when the exposure and formation of the image on the rear side is started, and also guide members G1, G2 and G3 are rotated to the positions illustrated by broken lines.

Accordingly, the recording paper on the intermediate tray 37 is conveyed again and reversed. Then, the recording paper is conveyed to the paper feeding guide section 33 through the conveyance rollers 38 and 39. After that, the recording paper is conveyed to the transfer region through the timing roller 34, so that the image is transferred and fixed onto the rear side of the recording paper.

The recording paper, on both sides of which the images are formed, is conveyed by the paper discharge rollers 27A and 27B, passes through guide member G2, and is discharged onto the recording paper tray 28. On the other hand, document D, the images on both sides of which have already been exposed, is conveyed by the conveyance belt 4 rotated clockwise, passed through guide member G1, and is discharged onto the document tray 8 through the paper discharge roller 7.

With reference to the flow charts shown in FIGS. 4 to 6, a copying process of mixed documents including one-sided and two-sided documents will be explained when the documents are copied by the apparatus of the present invention.

Figure 3A:
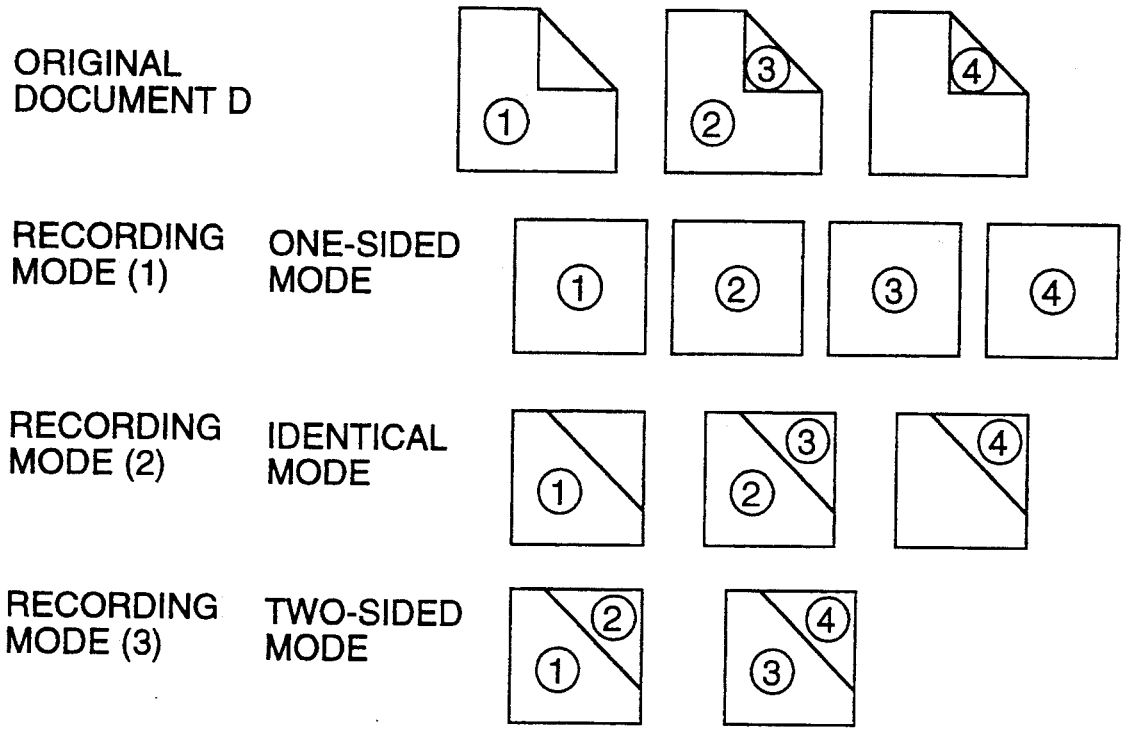
FIG. 3(*a*) is a schematic illustration of each image recording mode of the apparatus.
Figure 3B:
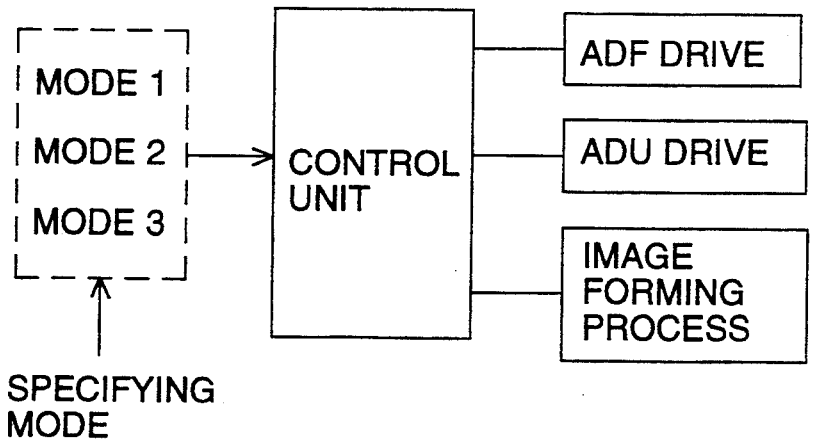

The objective documents are shown in FIG. 3(*a*) as follows:

Image ① is formed only on the front surface.

Images ② and ③ are formed on the front and rear sides.

Image ④ is formed only on the rear side.

The documents D are copied, for example, in the order shown in the drawing.

The image recording mode is selected with a mode selection button provided in the operation section of the image forming apparatus. In this case, the following three image recording modes are provided as shown in the drawing:

recording mode (1) in which all images are recorded on one side of a recording paper;

recording mode (2) in which all images are formed on the recording papers in the same manner as the documents; and recording mode (3) in which all images are successively formed on both sides of the recording papers.

When one of the modes is selected, by the action of the control section shown in FIG. 3(*b*), the functions of ADF I and ADU IV are performed with respect to the document and recording paper in accordance with the state of image recording, and image exposure section II and image forming section III are activated, so that the copying process is carried out in the predetermined recording mode.

Figure 4:
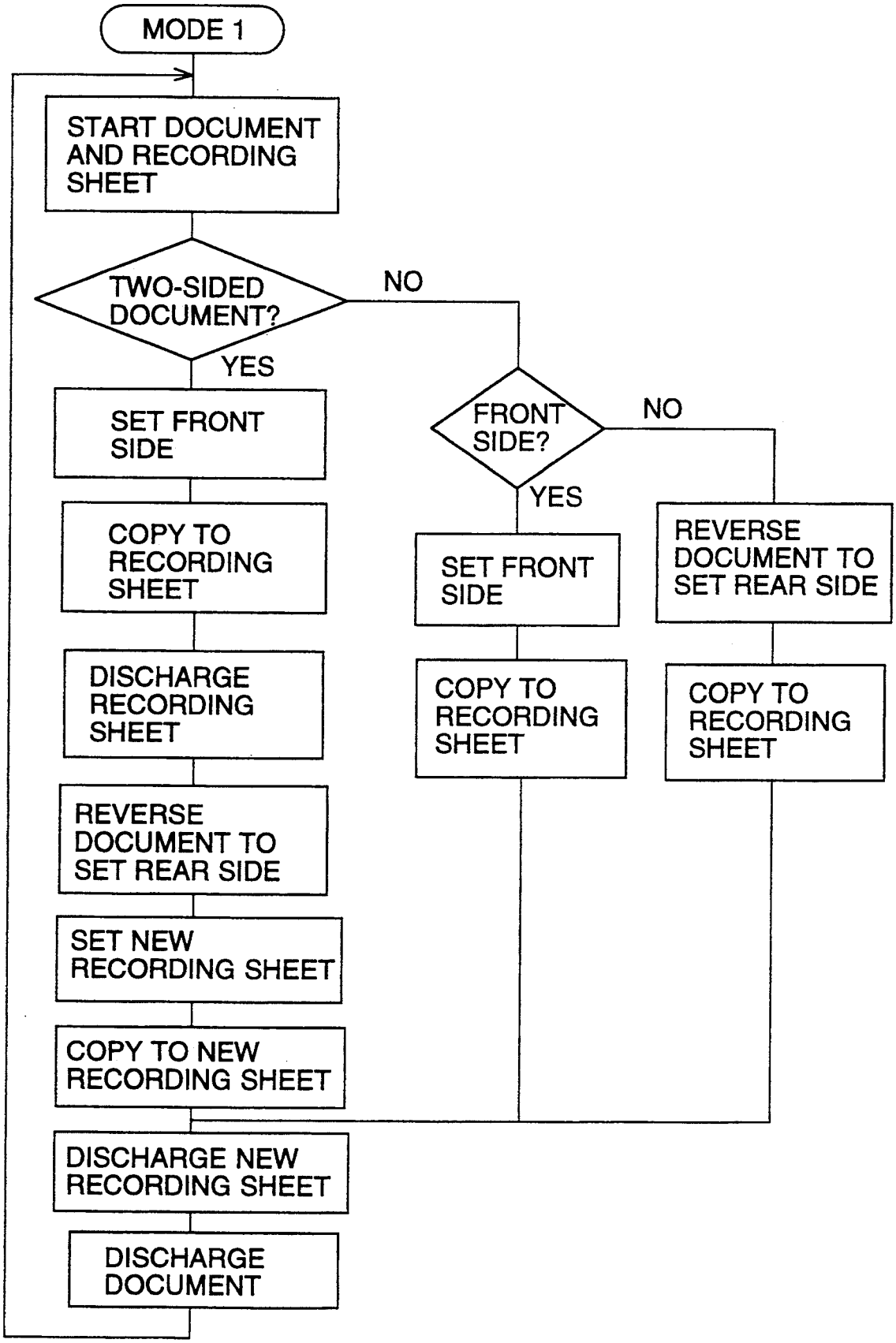
FIG. 4 is a flow chart showing a copying process of recording mode 1.
Figure 5:
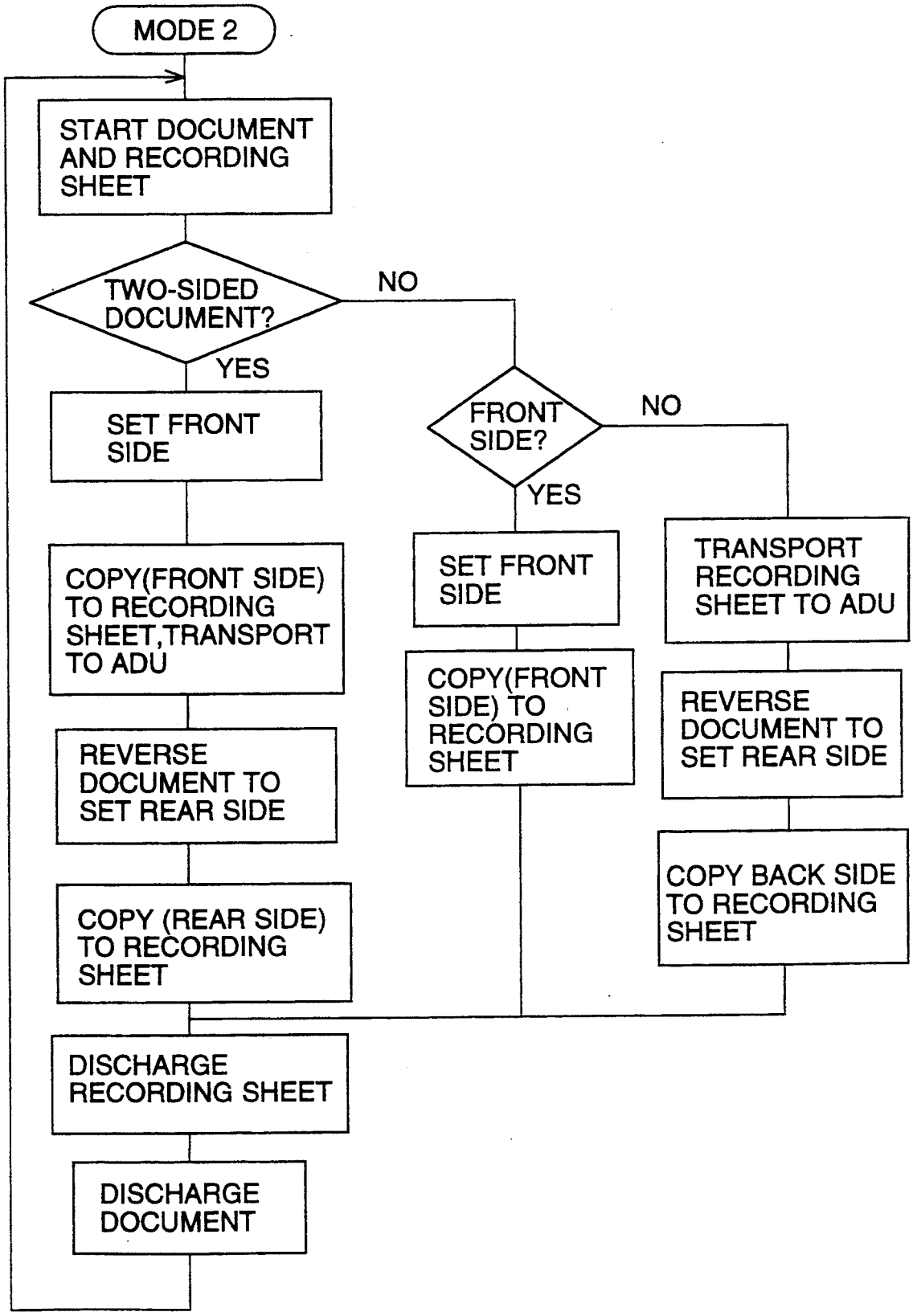
FIG. 5 is a flow chart showing a copying process of recording mode 2.

Referring to FIG. 4, the copying process of recording mode (1) is explained as follows.

When the copy button is pressed, a document D on the document tray 1 and a recording sheet are conveyed, and image detection is carried out by photosensors S1 and S2.

In the case where both photosensors S1 and S2 detect the existence of an image, the image on the front side of the recording paper is recorded on the recording paper in the same manner as that of one-sided documents described before, and then the recording paper is discharged onto the recording paper tray 28.

Next, document D is reversed by the same process as that when two-sided documents are copied. After that, the image on the rear side is recorded on a new recording paper. In the case where photosensor S2 detects no image on the rear side, the copying process is completed when the image on the front side has been recorded, and document D is discharged from the apparatus. In the case where photosensor S1 detects no image on the front side and photosensor S2 detects an image on the rear side, document D is reversed by ADF I, and image recording is conducted on a new recording paper.

In this way, the images on document D are successively recorded on the surface of a recording paper in the order shown in FIG. 3(*a*), that is in the order of images ①, ②, ③ and ④.

Next, with reference to FIG. 5, a copying process according to recording mode (2) will be explained as follows.

When the images on both sides of document D are detected by photosensors S1 and S2 so that document D is judged to be a two-sided document, the image on the front surface is first recorded, and then the recording paper, on the front surface of which the image has been recorded, is reversed by ADU IV, and document D is reversed by ADF I. In this way the image on the rear side of the document is recorded on the rear side of the recording paper.

In the case where only the image on the front surface of document D is detected by photosensor S1 so that document D is judged to be a one-sided document, the image is recorded by the same copying process as that of one-sided documents described above. In only the case where the image on the rear surface of document D is detected by photosensor S2 so that document D is judged to be a one-sided document having the image on the rear side, a recording paper conveyed out from the paper feed cassette 30 is reversed and the image is recorded on the rear side by ADU IV, whereby the image is not recorded on the front side of the recording paper, and document D is reversed to be subjected to exposure scanning, whereby the front side of document D is not exposed. In the recording mode (3), document D is discharged simultaneously when the recording paper is discharged.

As described above, the images on document D are recorded on the front and rear surfaces of the recording paper in the same manner as that of document D. That is, image ① is recorded on the front surface of the recording paper, images ② and ③ are recorded on the front and rear surfaces, and image ④ is recorded on the rear surface.

Figure 6:
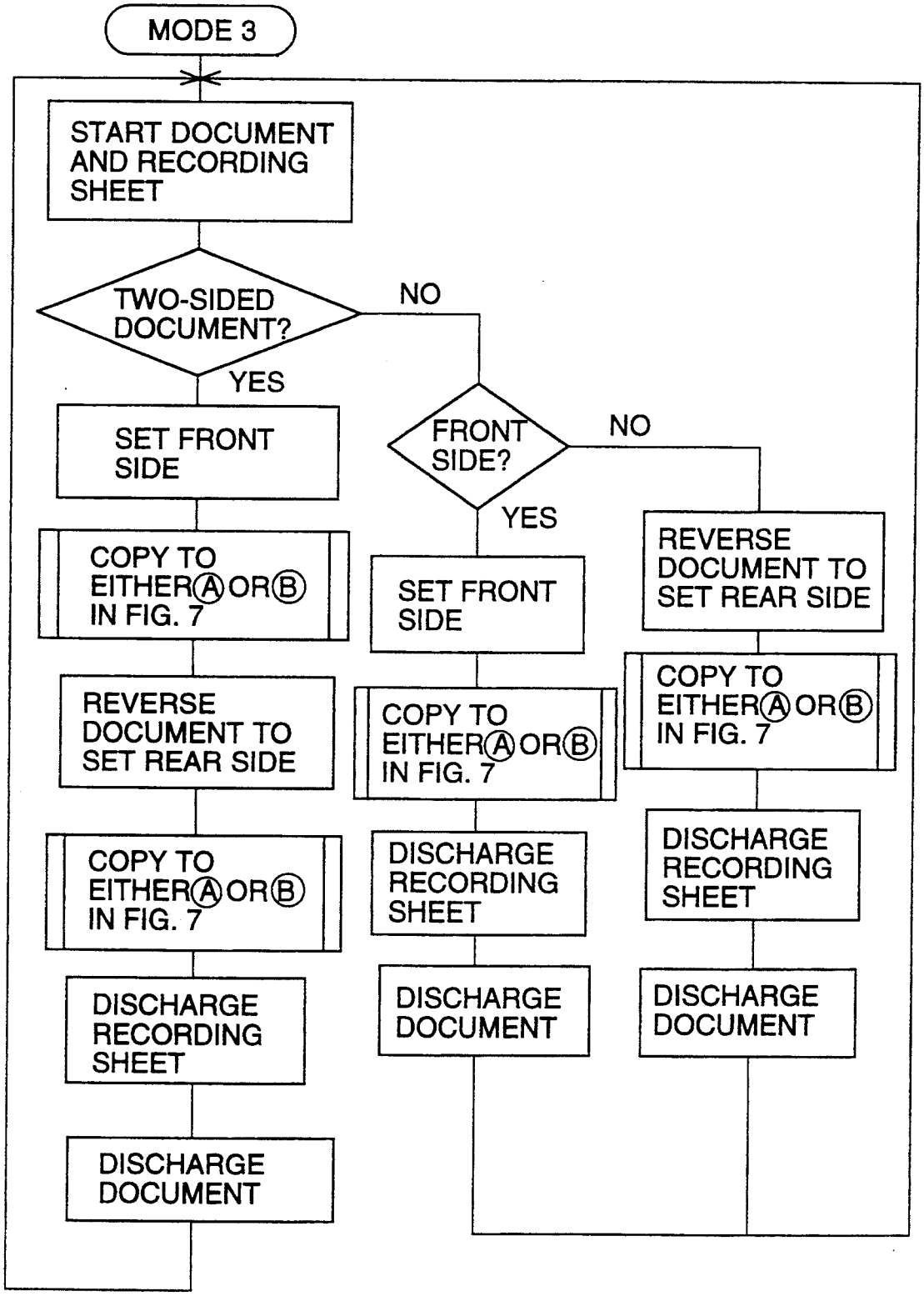
FIG. 6 is a flow chart showing a copying process of recording mode 3.
Figure 7:
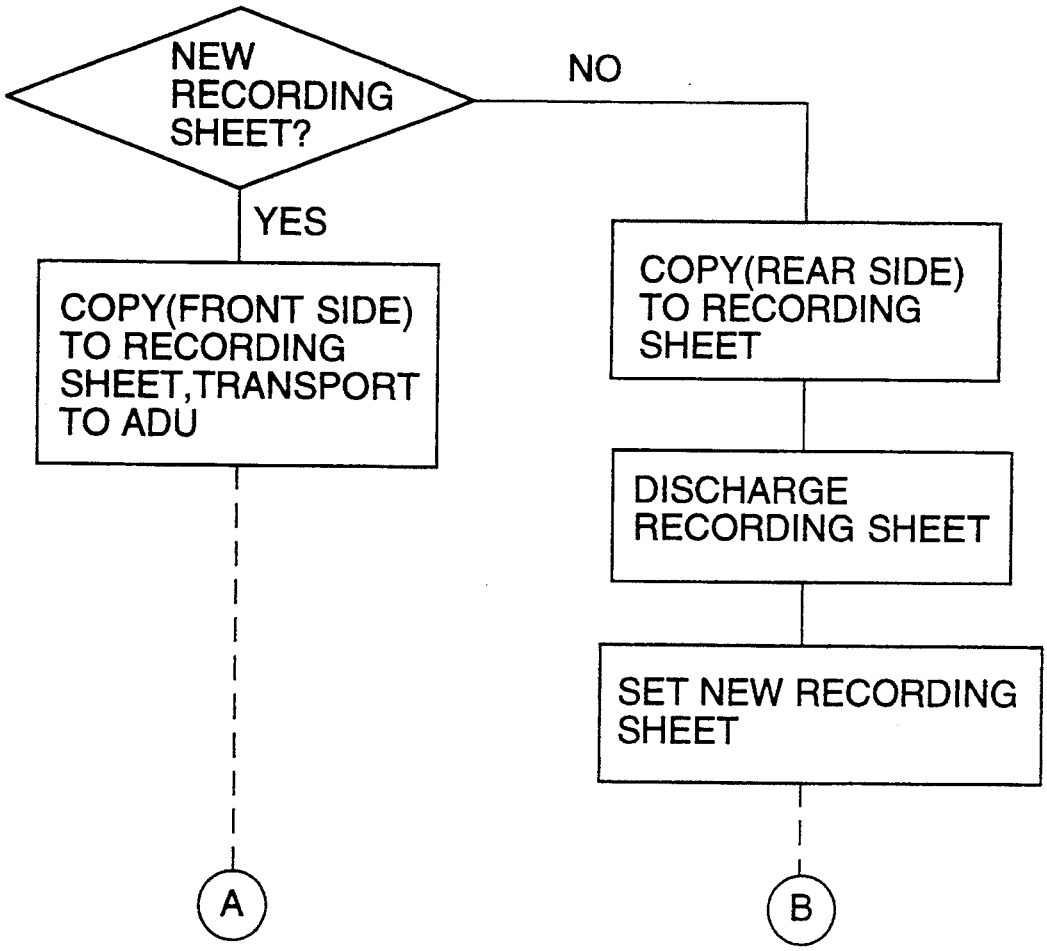
FIG. 7 is a flow chart of recording papers supplied in accordance with recording modes 3 and 7.

With reference to FIGS. 6 and 7, a copying process of recording mode (3) will be explained as follows.

When document D is detected as being a two-sided document by photosensors S1 and S2, an image on the front surface of document D is formed first, and the formed image is recorded on either recording paper A or B shown in FIG. 7. In the case where the recording paper is a new one that has been directly conveyed out from the paper feeding cassette 30, the image on the front surface of document D is recorded on the front surface of new recording paper A, and then the recording paper is reversed by ADU IV and ready for the next paper feeding operation. On the other hand, in the case where it is a recording paper B that has been conveyed out by ADU IV, on the front surface of which an image has already been recorded, the front surface image on document D is recorded on the rear side of recording paper B, and after recording paper B has been discharged, a new recording paper A is ready to be conveyed out. Document D, the front side image of which has been already recorded, is reversed by ADF I, and the rear side image is recorded on the rear surface of new recording paper A or on the front surface of a new recording paper A that has been newly supplied. After the images on the front and rear sides have been recorded, document D is discharged outside of the apparatus. Also, recording paper A, on the rear side of which the image has been recorded, is reversed by ADF IV and ready for the next paper feeding operation.

In the case of a one-sided document, the image of which has been detected only by photosensor S1, the front surface image is recorded either on the new recording paper A or on the recording paper B on which the image has already been recorded. On the other hand, in the case of a one-sided document, the image of which has been detected only by photosensor S2, document D is reversed by ADF I, and then the image is formed either on the surface of new recording paper A or on the surface of recording paper B.

As described above, the images on document D are successively recorded on the front and rear sides of the recording paper as shown in FIG. 3(*a*) in the order of images ①, ②, ③ and ④.

Figure 8:
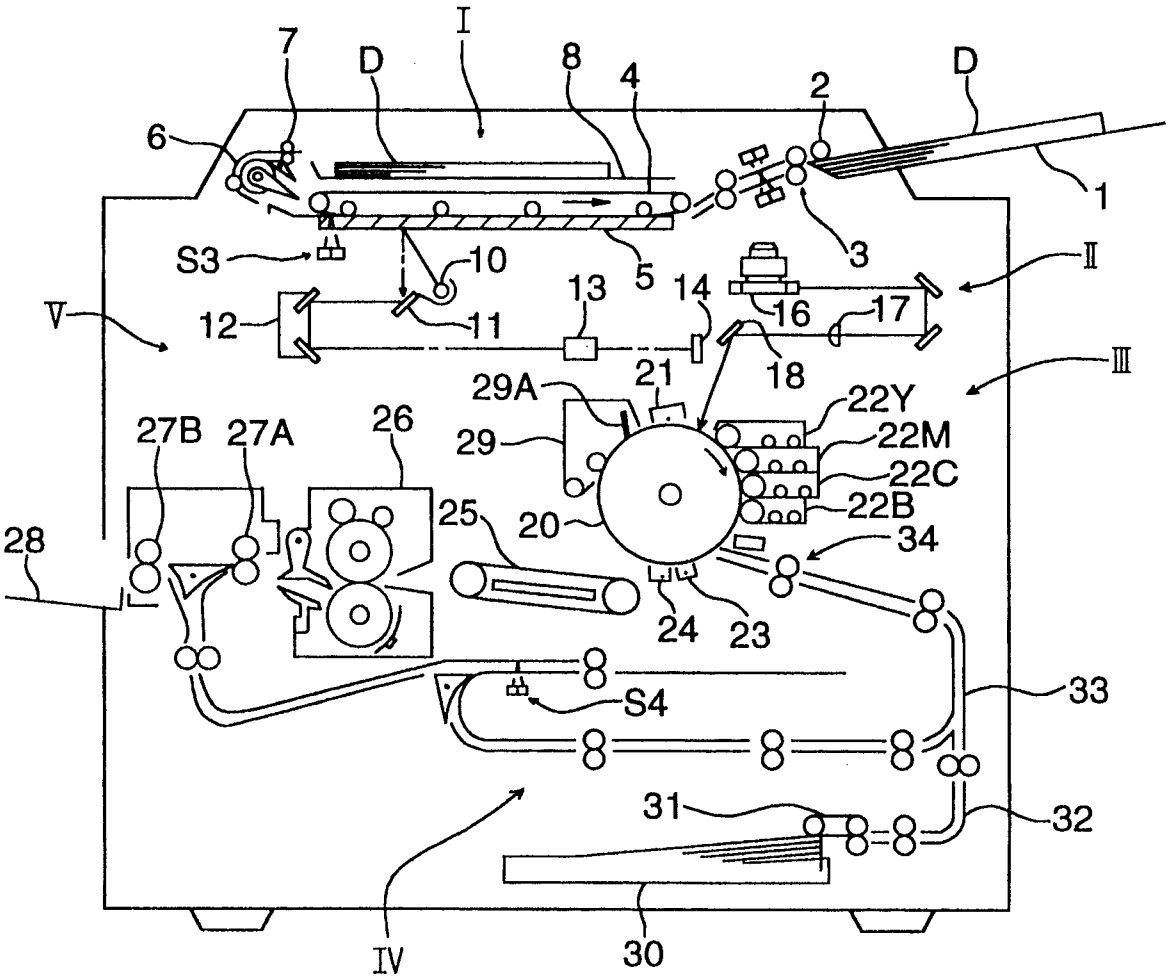
FIG. 8 is a schematic view showing the structure of the two-sided color image forming apparatus (part 1)
Figure 9:
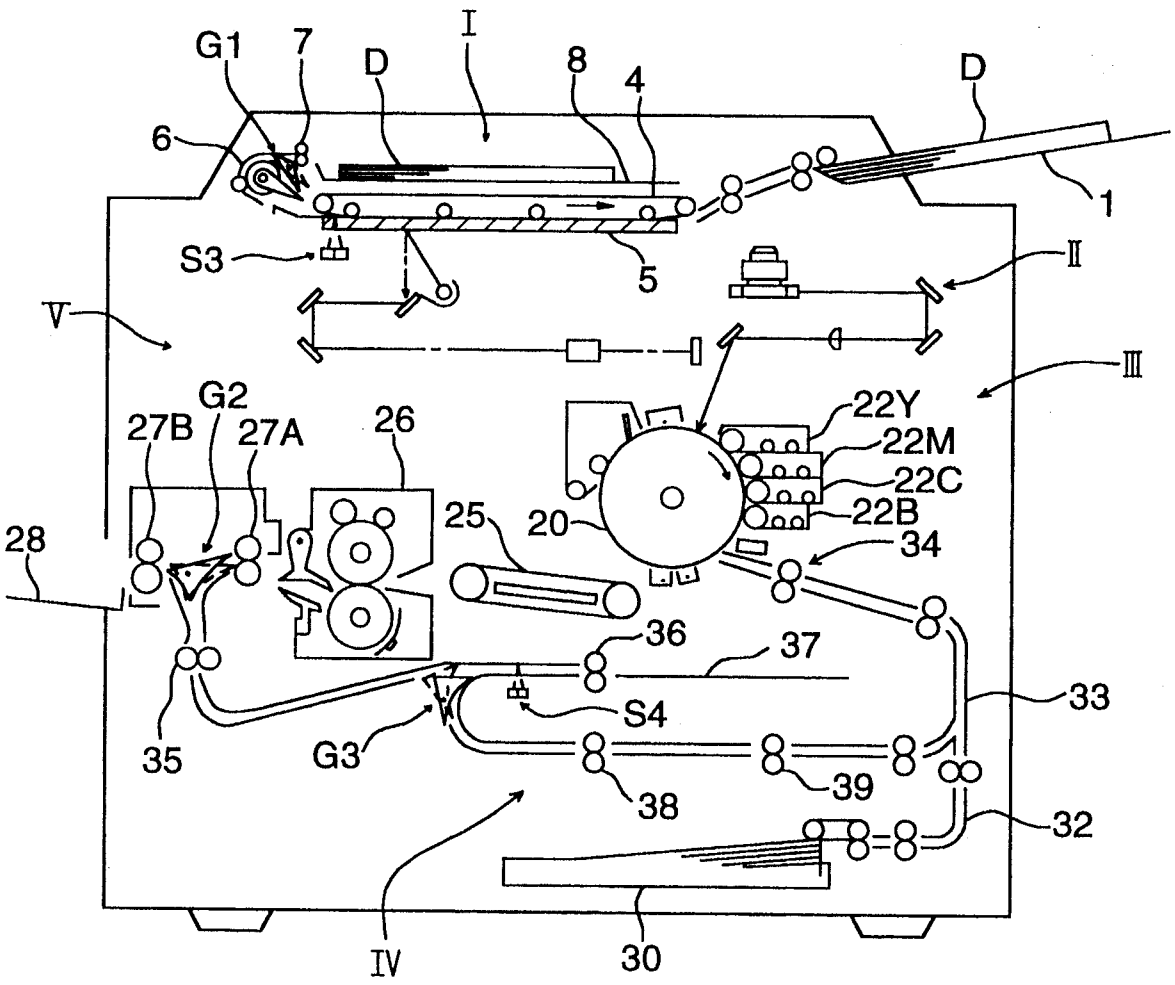
FIG. 9 is also a schematic view showing the structure of the color image forming apparatus (part 2)

FIGS. 8 and 9 are schematic views showing the structure of another example of the image forming apparatus of the present invention. This apparatus is composed of an automatic document feeder having a reversal function (ADF) I, image reading section V, image exposure section II, image forming section III, and automatic duplex copying unit (ADU) IV.

First, referring to FIG. 8, a copying process for one-sided documents carried out by the apparatus will be explained as follows.

Documents D are stacked on a document tray 1 of ADF I under the condition that the image surfaces of documents D are set downward. When a copy button is pressed, a conveyance roller 2 is rotated, so that the uppermost document of the stack and others are successively conveyed.

Only the uppermost document D is conveyed by the action of a double feed prevention roller 3. After that, the document D is fed onto a platen glass 5 by a conveyance belt 4.

When document D has been fed onto the platen glass 5, the leading edge of document D is detected by photosensor S3. Then, the rotation (clockwise) of the conveyance belt 4 is stopped, so that document D is stopped at a predetermined exposure position.

Next, image reading section V is operated, and exposure scanning is conducted by a first mirror 11 incorporating an exposure lamp 10, and a second mirror unit 12 that follows the first mirror 11 at half the speed of the first mirror 11. As a result of the foregoing exposure operation, the document image is projected onto a color CCD 14 through an image formation lens 13, and the document image is stored in the memory in the form of image data. This stored data is taken out from the memory for image recording, and inputted into image exposure section II.

In the case where the document image is a color image, the first color signal is inputted into image exposure section II from the memory, and a laser beam generated by a semiconductor laser not shown conducts a rotary scanning operation by the action of the polygonal mirror 16. Then, the optical path of the laser beam is deflected by the mirror 18 through the $f\theta$ lens 17. Therefore, the laser beam is projected on the circumferential surface of the photoreceptor drum 20 to which an electrical charge has already been given by the charger 21, so that a bright line is formed on the photoreceptor drum 20.

When a scanning operation starts, the beam is detected by the index sensor, and the beam is modulated by the first color signal, so that the circumferential surface of the photoreceptor drum 20 is scanned by the modulated beam. As a result of the foregoing operation, a latent image corresponding to the first color is formed on the circumferential surface of the photoreceptor drum 20 by the primary scanning conducted by the laser beam and the auxiliary scanning conducted by the conveyance of the photoreceptor drum 20. This latent image is subjected to reversal development under a non-contact condition so that a toner image is formed, wherein the development is conducted by the developing unit 22Y in which yellow (Y) toner is charged. While the formed toner image is held on the drum surface, it passes under the cleaning means 29 separated from the circumferential surface of the photoreceptor drum 20, and then the next copy cycle starts.

The next operation is carried out in the following manner. The photoreceptor drum 20 is charged again by the charger 21. Next, the second color signal outputted from the signal processing section is inputted into the image exposure section II, and then the image information is written on the drum surface so as to form a latent image in the same manner as that of the case of the first color signal. The latent image of the second color is subjected to non-contact reversal development conducted by the developing unit 22M in which magenta (M) toner is contained.

This magenta (M) toner image is formed on yellow (Y) toner image that has already been formed.

Numeral 22C is a developing unit having cyan (C) toner, and forms a toner image of cyan (C) on the drum surface in accordance with a control signal generated in the signal processing section.

Numeral 22B is a developing unit in which black toner is charged, and forms a black toner on the drum surface in the same manner, wherein the black toner image is superimposed on the images that have already been formed. A DC or DC/AC bias voltage is impressed upon the developing units 22Y, 22M, 22C and 22B, and jumping-development is carried out by one-component or two-component developer, so that reversal-development is conducted under a non-contact condition on the photoreceptor drum 20, the base of which is grounded.

After the image has been read, the conveyance belt 4 is rotated again, and document D is discharged onto the document tray 8 through the reversal guide 6 by the discharge roller 7. In the case where no image is detected by the color CCD 14, document D is not stopped on the platen glass 5 but sent onto the document tray 8. Consequently, the exposure operation is not conducted by image exposure section II.

Simultaneously when the process is carried out in image exposure section II and image forming section III, a recording paper is conveyed out from the paper feed cassette 30 in ADU IV. By the action of the double feed prevention roller 31, one sheet of recording paper is fed to the timing roller 34 through the paper feed guides 32 and 33. In a timed relation with the rotation of the timing roller 34 synchronized with the toner image formation on the photoreceptor drum 20, the recording paper is sent to the image transfer region.

The toner image formed on the drum surface is transferred by the transfer unit 23 onto the recording paper fed to the transfer region, and then the recording paper is separated from the drum surface by the action of the discharger 24. After that, the recording paper is fed to the fixing unit 26 through the conveyance belt 25. After the image has been fused and fixed onto the recording paper, it is discharged onto the recording paper tray 28 by the paper discharge rollers 27A and 27B.

After the recording paper has been separated from the photoreceptor drum 29, the blade 29A of the cleaning unit 29 comes into pressure contact with the surface of the photoreceptor drum 29 at the fifth revolution, and the residual toner on the photoreceptor drum 29 is removed. After the cleaning operation, the photoreceptor drum 29 is electrically charged again by the charger 21, and the next image forming process starts.

In the case where the document image is monochromatic, only a color signal corresponding to black is inputted into image exposure section II by the action of the memory, so that a monochromatic toner image is formed.

With reference to FIG. 9, a copying process for a two-sided document image carried out by the apparatus will be explained as follows.

In the same manner as a one-sided document, an image on the front surface of document D conveyed out from the document tray 1 is exposed so as to be formed on the photoreceptor drum, and the formed image is transferred and fixed onto a recording sheet.

The recording paper onto which the image has been fixed is guided by guide members G2 and G3 previously rotated to a position illustrated by a solid line, and conveyed by the conveyance rollers 35 and 36 onto the intermediate tray 37. Then, the recording paper is pinched and held by the conveyance rollers 36 that have been stopped in accordance with a detection signal of the trailing end of the recording paper detected by photosensor S4.

On the other hand, document D, one image side of which has already been exposed is conveyed to the reversal guide section 6. Then, document D is fed onto the platen glass 5 again being guided by guide member G1 previously rotated to a position illustrated by a solid line in the drawing and being rotated counterclockwise by the conveyance belt 4 under the condition that document D is reversed. In this case, document D is stopped at a predetermined exposure position when the trailing end is detected by photosensor S3, the detection mode of which has been changed over.

Next, synchronously with exposure of an image on the rear surface of document D, the conveyance roller 36 is reversed, and guide members G1, G2 and G3 are rotated together to a position illustrated by a broken line.

Consequently, a recording paper on the intermediate tray 37 is conveyed again and reversed. After that, the recording paper is conveyed to the paper feed guide section 33 by the conveyance rollers 38 and 39. Then, it is conveyed to the transfer region through the timing roller 34 so that the image is transferred and fixed onto the rear surface of the recording paper.

The recording paper, on both surfaces of which images have been formed in this way, is conveyed by the paper discharge rollers 27A and 27B, passed above guide member G2, and then discharged onto the recording paper tray 28. On the other hand, document D, the images on both sides of which have already been exposed, is conveyed clockwise by the conveyance belt 4 so that document D is reversed. Then, document D passes above guide member G1, and is discharged onto the document tray 8 by the paper discharge roller 7.

With reference to the flow charts shown in FIGS. 11, 12, 13 and 7, a copy process of mixed documents including both one-sided and two-sided monochromatic and color documents will be explained as follows.

Figure 10A:
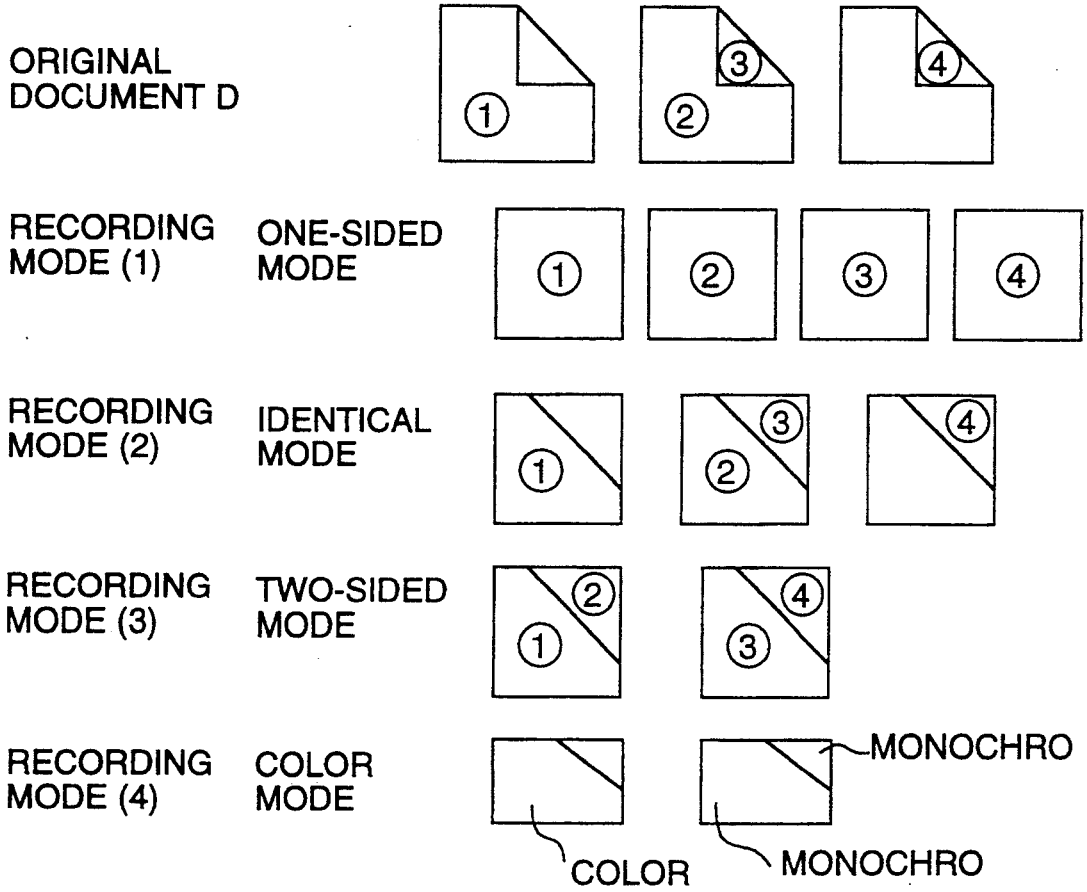
FIG. 10(*a*) is a schematic illustration of each image recording mode of the apparatus.

In this case, as shown in FIG. 10(a), objective documents D are provided in the following manner:

Image ① is formed only on the front surface.

Images ② and ③ are respectively formed on the front and rear sides.

Image ④ is formed only on the rear side.

The documents are copied in the order shown in the drawing.

The image recording mode is selected with a mode selection button provided in the operation section of the image forming apparatus. In this case, the following four image recording modes are provided as shown in the drawing:

recording mode (1) in which all images are recorded on one side of a recording paper;

recording mode (2) in which all images are formed on the recording papers in the same manner as the documents;

recording mode (3) in which all images are successively formed on both sides of the recording papers; and recording mode (4) in which color document images are recorded on both sides of the recording papers or on one of the sides of the recording papers.

Figure 10B:
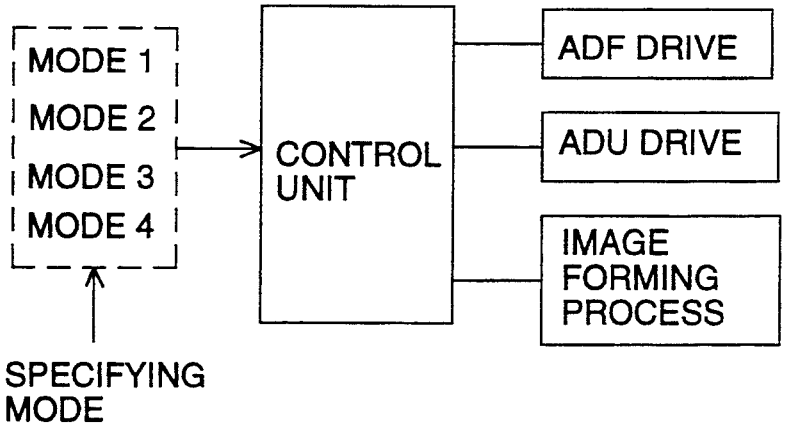

When one of the modes is selected, by the action of the control section shown in FIG. 10(*b*), the functions of ADF I and ADU IV are performed with respect to the document and recording paper in accordance with the state of image recording, and image exposure section II, image forming section III and image reading section V are activated, so that the copying process is carried out in a predetermined recording mode.

Figure 11:
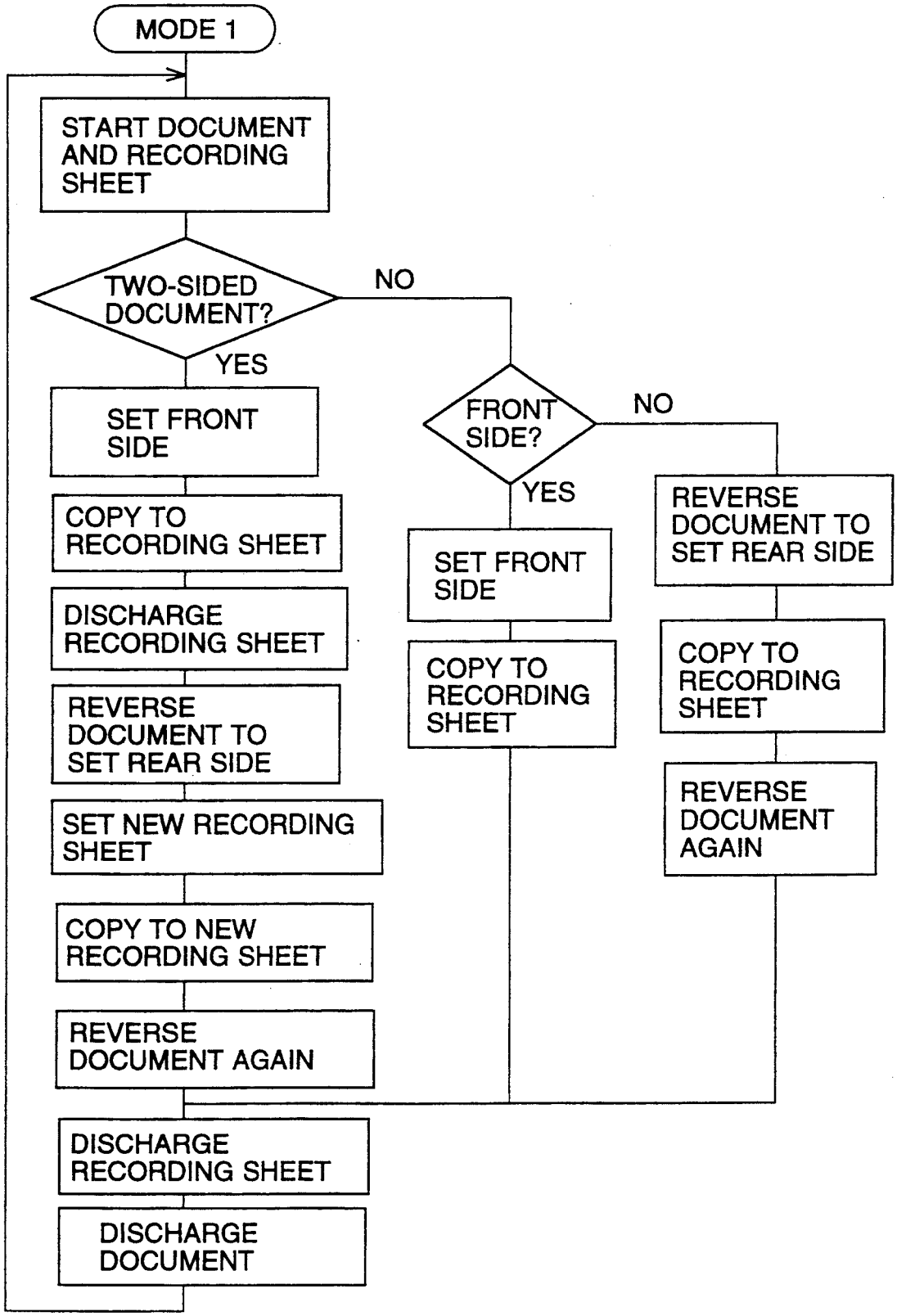
FIG. 11 is a flow chart showing a copying process of recording mode 4.

With reference to FIG. 11, a copying process according to recording mode (1) in which monochromatic images are copied will be explained as follows.

The copying operation is carried out in the following manner:

When the copy button is turned on, a document D on the document tray 1 and a recording paper in the paper feed cassette 30 are conveyed. When document D is moved on the platen glass 5, it is judged by the color CCD 14 of image reading section V that is in a stationary condition, whether or not there is an image on the front surface of document D. Then, the document is conveyed by the conveyance belt 4 through the reversal guide 6 and guide member G1 rotated by an angle shown in FIG. 9, so that the document is reversed. Under the condition that the document is reversed, it is conveyed onto the platen glass again, and it is judged whether or not there is an image on the rear surface of document D.

In the case where the color CCD 14 has detected images on both the front and rear sides, document D is conveyed by the conveyance belt 4 rotated in the normal direction, and it passes through the reversal guide 6, and document D is conveyed onto the platen glass under the condition that the front side of document D is set downward by the actions of guide member G1 and the conveyance belt 4. Then, document D is stopped on the exposure surface by the action of a trailing end detection signal sent from of photosensor S3. In this way, the image on the front surface of the document is recorded on a recording paper in the same process as that explained in a case in which one-sided documents are copied. After the completion of recording, the recording paper is discharged onto the recording paper tray 28.

In the same process as that explained in a case in which two-sided documents are copied, document D is reversed, and then an image on the rear surface is recorded on a new recording paper. In the case where the sensor detects no image on the rear surface, the copy process is completed when the image on the front surface has been recorded. In the case where the sensor detects no image on the front surface of the document and the sensor detects an image only on the rear surface, document D is reversed by ADF I, and then image recording is conducted on a new recording paper.

As shown in recording mode (1) in FIG. 10(*a*), each image on document D is recorded on the front surface of a recording paper in the order of images ①, ②, ③ and ④.

After the image on the rear surface has been recorded, document D is reversed, and discharged under the condition that the front surface is set upward.

Figure 12:
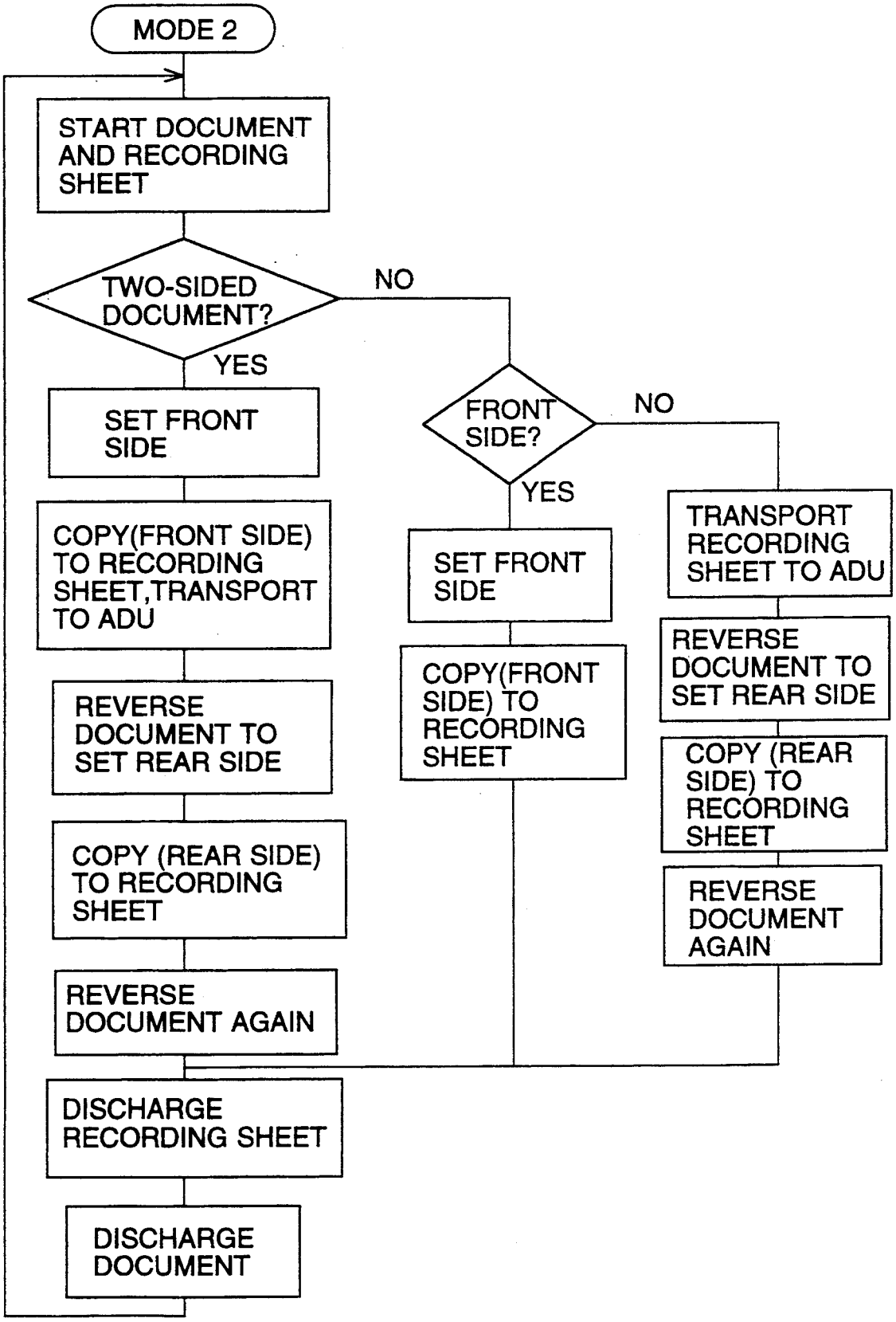
FIG. 12 is a flow chart showing a copying process of recording mode 5.

Next, with reference to FIG. 12, a copying process of recording mode (2) will be explained as follows.

In the case where the images on document D have been detected by the color CCD 14 and the document has been judged to be a two-sided document, first, the image on the front surface is recorded, and then the recording paper on which the image has been recorded is reversed by ADU IV, and document D is reversed by ADF I, so that the image on the rear side of the document is recorded on the rear side of the recording paper.

In the case where document D is a one-sided document on the front surface of which an image is formed, the image is recorded by the same copy process as that of a case in which one-sided documents are copied. In the case where document D is a one-sided document, on the rear surface of which an image is formed, the recording paper conveyed out from the paper feed cassette 30 is reversed by ADU IV, wherein no image is formed on the front surface, and document D is reversed, wherein the front surface of document D is not read. Under the condition, image recording is carried out.

As shown in recording mode (2) in FIG. 10(*a*), each image on document D is recorded on the surface of a recording paper in the same manner as that of document D itself in such a manner that: image ① is recorded on the front surface of the recording paper; image ② is recorded on the front surface of the recording paper, and image ③ is recorded on the rear surface of the recording paper; and image ④ is recorded on the rear surface of the recording paper.

Figure 13:
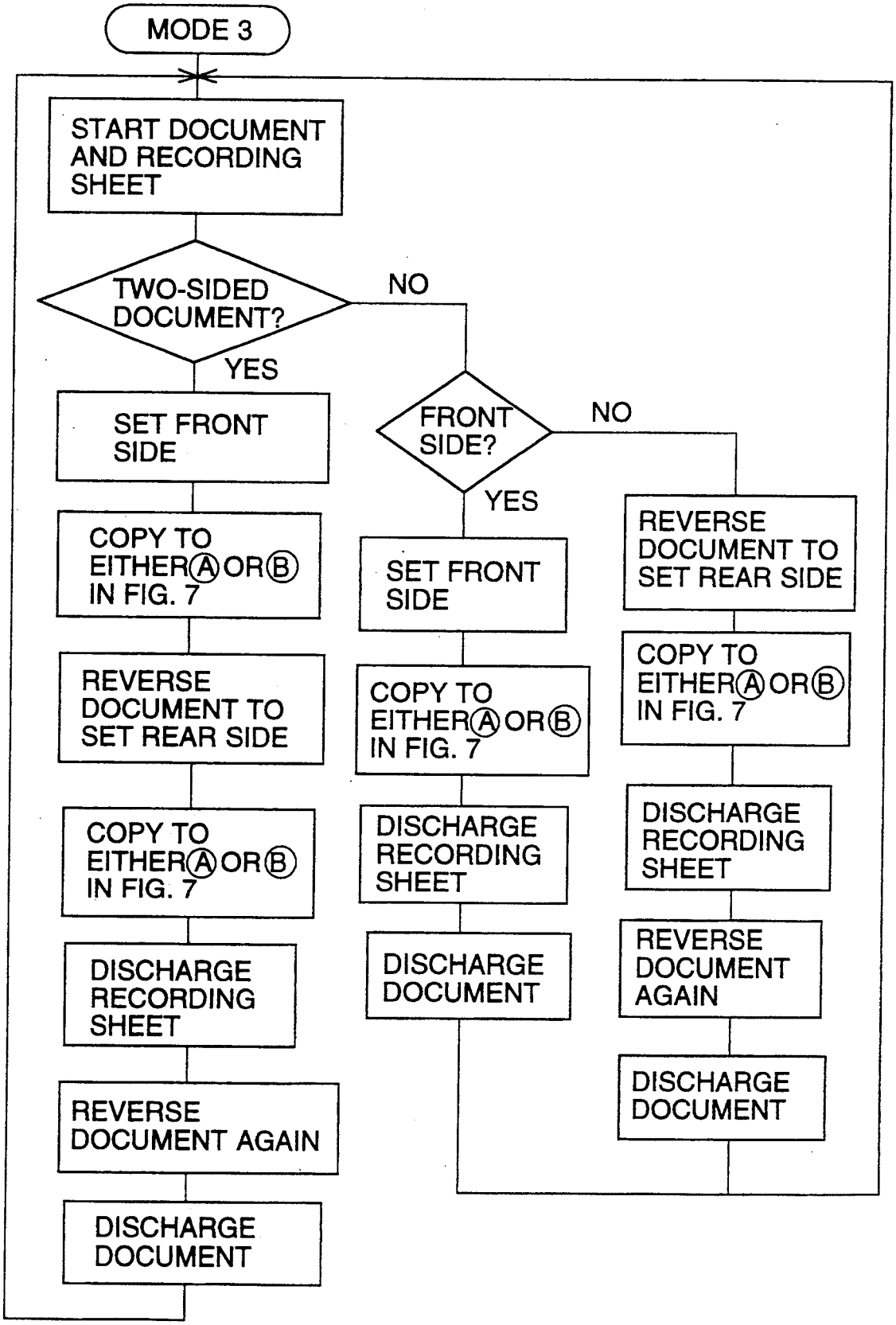
FIG. 13 is a flow chart showing a copying process of recording mode 6.

Moreover, with reference to FIGS. 7 and 13, a copy process of recording mode (3) will be explained as follows.

In the case where it has been judged that document D is a two-sided document, the formation of an image on the front surface of document D is carried out. This image is recorded on either recording paper A or B shown in FIG. 7. That is, in the case where the recording paper is a new one A that has been directly conveyed out from the paper feed cassette 30, the front surface image of document D is recorded on the front surface of new recording paper A, and then the recording paper is reversed by ADU IV so as to be prepared for refeeding. In the case where the recording paper is a recording paper B that has already been recorded and conveyed out from ADU IV, the front surface image on document D is recorded on the rear surface of recording paper B, and after recording paper B has been discharged, new recording paper A is ready to be conveyed out. After, the front surface image has been recorded, document D is reversed by ADF I, and the rear surface image is recorded on the rear surface of new recording paper A or on the rear surface of new recording paper A that is newly fed. After the completion of copy of the front and rear surface images, document D is discharged outside. After the image has been recorded on the rear surface, recording paper A is discharged outside. Recording paper A, on the front surface of which the image has already been recorded, is reversed by ADU IV so as to be ready for refeeding.

In the case where document D is a one-sided document, only on the front surface of which an image is provided, the front surface image is recorded either on the new recording paper A or the recording paper B on which an image has already been recorded. On the other hand, in the case where document D is a one-sided document, only on the rear surface of which an image is provided, document D is reversed by ADF I, and then the image is recorded on the front surface of new recording paper A or the front surface of recording paper B.

As shown in recording mode (3) in FIG. 10(*a*), the images on document D are recorded on the front and rear surfaces of the recording paper in the order of copying, that is, the images on document D are successively recorded in the order of images ①, ②, ③ and ④.

In the present invention, in the case where a document has a color image, the color image is formed only on the front surface of the recording paper, and then the recording paper is discharged. In the case where the document is a one-sided color document, the color image is formed only on one surface of a new recording paper and the recording paper is discharged irrespective of the existence of a recording paper that has been previously recorded.

Figure 14:
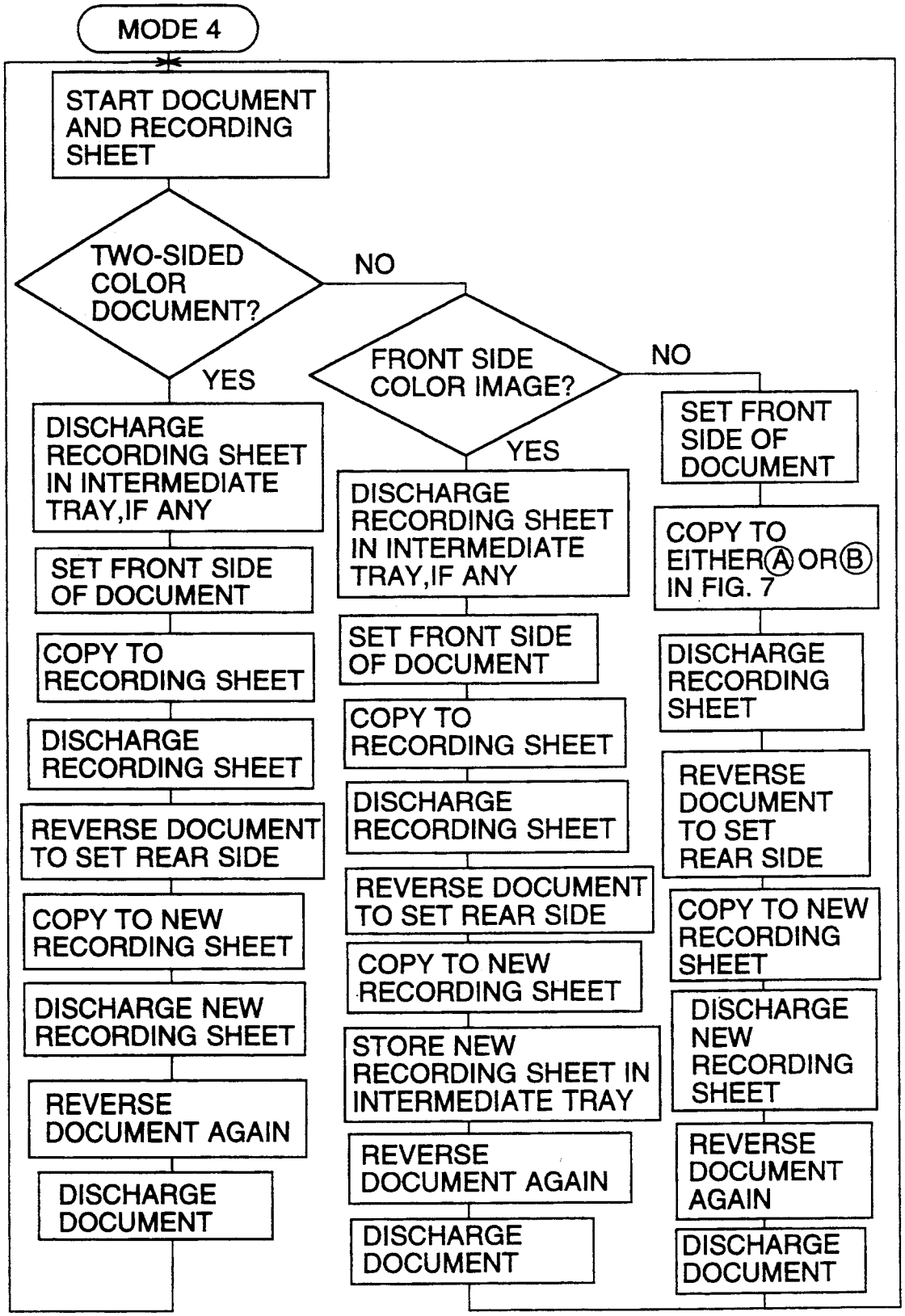
FIG. 14 is a flow chart showing a copying process of recording mode 8.

Next, a copying process in the case where color images are included in two-sided documents will be explained by reference to FIG. 14. When both sides of document D include color images, the operation is carried out in the following manner:

First, in the case where there is a recording paper on the intermediate tray 37 shown in FIG. 9, they are discharged.

Next, image formation of the color image on the front surface of document D is started, and a color toner image is formed by the process described above, and then the color toner image is recorded on a recording paper fed from the paper feed cassette 30. This recording paper is immediately discharged onto the recording paper tray 28 while an image is not recorded on the rear surface.

Next, after document D has been reversed, the image formation of the color image on the rear side is carried out, and the formed color image is recorded on a new recording paper fed from the paper feed cassette 30. After that, the recording paper is discharged onto the recording paper tray 28 in the same manner as the previous recording paper.

After the color image on the rear side has been recorded, document D is reversed again and discharged onto the document tray 8 under the condition that the front surface is set upward.

When a color image is provided on the front surface of document D, the operation is carried out in the following manner:

In the case where there is a recording paper on the intermediate tray 37, it is discharged. Then a color toner image formed from the color image on the front surface is recorded on a recording paper fed from the paper feed cassette 30. This recording paper is immediately discharged onto the recording paper tray 28 while no image is formed on the rear side.

After document D has been reversed, the image formation of a monochromatic image on the rear side is carried out, and the formed image is recorded on a new recording paper fed from the paper feed cassette 30. This recording paper is accommodated in the intermediate tray 37.

After the monochromatic image on the rear side has been recorded, document D is reversed again and discharged onto the document tray 8 under the condition that the front side is set upward.

When it has been judged that a color image is provided on the rear side of document D, the operation is carried out in the following manner:

A monochromatic image on the front side is recorded either on recording paper A or B shown in FIG. 7. That is, in the case where the recording paper is a new one A directly fed from the paper feed cassette 30, the monochromatic image on the front surface of document D is recorded on the front surface of new recording paper A. After that, the recording paper is reversed by ADU IV so as to be ready for refeeding.

On the other hand, in the case where the recording paper is a recording paper B that has been conveyed out from ADU IV, on the front surface of which an image has already been recorded, the monochromatic image on document D is recorded on the rear surface of recording paper B.

Next, after document D has been reversed, the image formation of a color image on the rear surface is carried out. The formed image is recorded on a new recording paper fed from the paper feed cassette 30, and the recording paper is discharged onto the recording paper tray 28. At the same time document D is reversed and discharged onto the document tray 8 under the condition that the front surface is set upward.

According to the present invention, in either case of two-sided documents, one-sided documents or mixed documents including both two-sided and one-sided documents, a color image forming apparatus can be realized in which document images can be copied in an arbitrary embodiment when a copy mode is selected between a monochromatic or a color copy mode. As a result of the foregoing, a very useful apparatus can be provided in which documents can be recorded as they are, or they can be recorded in a sorted form even when the documents are irregularly disposed.

What is claimed is:

1. An image forming apparatus comprising:

(a) feeder means for feeding one by one a plurality of mixed documents including one-sided image documents and two-sided image documents to a reading station for copying said mixed documents on a plurality of recording sheets;

(b) discriminating means for discriminating whether each of the plurality of mixed documents is one of a one-sided image document and a two-sided image document; and (c) means for selecting a copying mode so that the plurality of mixed documents are copied in one of a one-sided copying mode wherein all images of the plurality of mixed documents are respectively copied on only one side of each of the plurality of recording sheets, a two-sided copying mode wherein all images of the plurality of mixed documents are copied on two sides of each of said plurality of recording sheets, and another copying mode wherein the images are copied in an order that corresponds to an order of the images on the plurality of mixed documents in accordance with a predetermined desired copying mode; and wherein when the two-side copying mode is selected by said selecting means and when said discriminating means discriminates an absence of an image on one side of a document, one-sided copying for said one side of said document is inhibited.

2. An image forming apparatus comprising:

(a) feeder means for feeding one by one a plurality of mixed documents including one-sided image documents and two-sided image documents to a reading station for copying said mixed documents on a plurality of recording sheets;

(b) discriminating means for discriminating whether each of the plurality of mixed documents is one of a one-sided image document and a two-sided image document, and for determining whether the documents are one of a monochromatic image document and a color image document; and (c) means for selecting a copying mode so that the plurality of mixed documents are copied in one of a one-sided copying mode, a two-sided copying mode, and another copying mode wherein all images are copied in an order that corresponds to an order of the images on the plurality of mixed documents in accordance with a predetermined desired mode.

3. The image forming apparatus of claim 2, further comprising means for controlling said image forming apparatus so that all images of the plurality of mixed documents are respectively copied on only one side of each of the plurality of recording sheets.

4. The image forming apparatus of claim 2, further comprising means for controlling said image forming apparatus so that all images of the plurality of mixed documents are copied on two sides of each of said plurality of recording sheets.

5. The image forming apparatus of claim 2, further comprising means for controlling said image forming apparatus so that all images of the plurality of mixed documents are copied on recording sheets in an order that is identical to an order of the plurality of mixed documents.

6. The image forming apparatus of claim 4, further comprising means for controlling said image forming apparatus so that when images of the plurality of mixed documents are color images, all images on the plurality of mixed documents are respectively copied on only one side of each of the plurality of recording sheets.

7. The image forming apparatus of claim 5, further comprising means for controlling said image forming apparatus so that when images of the plurality of mixed documents are color images, all images on the plurality of mixed documents are respectively copied on only one side of each of the plurality of recording sheets.

* * * * *

UNITED STATES PATENT AND TRADEMARK OFFICE

CERTIFICATE OF CORRECTION

PATENT NO. : 5,347,351

DATED : September 13, 1994

INVENTOR(S) : MORITA et al.

It is certified that error appears in the above-indentified patent and that said Letters Patent is hereby corrected as shown below:

Title page, Item [57] ABSTRACT, line 2 change "input thereto" to --documents--;

line 3 after "ments", insert --input thereto"

Signed and Sealed this

Twenty-fourth Day of September, 1996

*Attest:*

Bruce Lehman

BRUCE LEHMAN

*Attesting Officer*

*Commissioner of Patents and Trademarks*